United States Patent [19]

Smith

[11] Patent Number: 5,024,016

[45] Date of Patent: Jun. 18, 1991

[54] SELF-LOADING PISTOLS

[75] Inventor: David E. Smith, Ramsey, Isle of Man

[73] Assignee: Victory Arms Co., Limited, London, England

[21] Appl. No.: 428,224

[22] Filed: Oct. 27, 1989

Related U.S. Application Data

[63] Continuation-in-part of Ser. No. 274,203, Nov. 21, 1988, abandoned.

[30] Foreign Application Priority Data

Dec. 1, 1987 [GB] United Kingdom ..... 8728052

[51] Int. Cl.[5] ..... F41A 15/10

[52] U.S. Cl. ..... 42/25; 42/1.07; 42/77

[58] Field of Search ..... 42/25

[56] References Cited

U.S. PATENT DOCUMENTS

| | | | |
|---|---|---|---|
| H211 | 2/1987 | Vanderbeck | 42/25 |
| 1,039,232 | 9/1912 | Wesson | 42/25 |
| 1,068,752 | 7/1913 | Febiger | 42/25 |
| 2,635,377 | 4/1953 | Higson | 42/25 |
| 2,711,041 | 6/1955 | Harvey | 42/25 |
| 4,615,132 | 10/1986 | Smith | 42/25 |

FOREIGN PATENT DOCUMENTS

| | | |
|---|---|---|
| 0240845A1 | 10/1987 | European Pat. Off. . |
| 2137323A | 10/1984 | United Kingdom . |

*Primary Examiner*—Stephen C. Bentley

*Attorney, Agent, or Firm*—Harness, Dickey & Pierce

[57] ABSTRACT

A variable caliber self-loading pistol has a slide carried by a breech block slide of the gun with this slide projecting forwardly of the breech block slide so as to support the underside of a cartridge during initial rearward movement of the breech block slide as that cartridge is being extracted from the chamber. The slide also assists in preventing premature movement of a fresh round of ammunition upward from a magazine into the chamber.

6 Claims, 3 Drawing Sheets

SELF-LOADING PISTOLS

This application is a continuation-in-part of application Ser. No. 274,203 filed Nov. 21, 1988, now abandoned.

This invention relates to firearms of the self-loading pistol type in which a reciprocating breech block slide is employed, the rear portion of said slide having an extractor mounted adjacent to a breech face and a movable projecting rib that allows a clear breech face during the cartridge feeding cycle, yet provides a positive support for various size cartridge rims opposite the extractor during the extraction and ejection cycle.

The usual practice in self-loading pistols is to have the breech face of the slide breech vertically flush to allow the cartridge base to slide freely up the face during the feeding cycle.

The disadvantage of the aforesaid practice is that the flush breech face necessitates a side mounted extractor and an opposing solid shoulder on the breech face to support and keep aligned with the barrel chamber the cartridge against the lateral pressure of the spring loaded extractor during the extraction cycle.

Another practice in self-loading pistols is to have a top mounted extractor mounted over a recessed slide or bolt face, the periphery of the recess supplying alignment and support for the cartridge during the extraction cycle.

The disadvantage of the aforesaid practice is that the chambering cartridge must lift or cam the extractor aside to seat in the breech face recess and the design does not allow a high cartridge position for feeding.

Greater convenience would be provided by a projection on the breech face that would move to allow a flush breech face during the cartridge feeding cycle, yet would automatically move to project under the cartridge base rim to supply alignment and support during the extraction and ejection cycle. The later disclosed self-loading pistol has a mechanism that would allow cartridges of varying case base diameter to be used in a pistol or other firearm without having to use more than a single breech block unit or slide.

The pistol or self-loading firearm as later described can accommodate varying cartridge case base diameters and yet is of simple construction and cheap to manufacture.

According to the invention, there is provided a firearm of the self-loading pistol type comprising a frame; a reciprocating breech block slide mounted for reciprocating movement in the frame, said breech block slide having an undersurface and including means defining a longitudinally extending slot; a cartridge extractor and a firing pin carried by the breech block slide; and a floating under rib having a projection receivable within the slot, said floating rib being capable of limited longitudinal movement between a forward position and a rearward position relative to the breech block slide by virtue of the extent of the slot accommodating the floating rib projection, said floating rib having a forward end which in the forward position of the rib projects beyond the undersurface of said breech block slide.

Preferably, the floating rib projection has a plurality of longitudinally extending slits therein and a plurality of retaining pins are carried by the breech block slide and are received within said slits to retain the projection in the slot.

In order to allow the breech face and projecting sliding rib to be used with cartridges of varying base diameters, it is possible, for different chambered barrels, to lift or lower the axis of the bore of the barrel within dimensional limitations, only limited by the requirements of the firing pin to align with the primer in the cartridge chambered in the barrel breech.

The invention will be further described with reference to the accompanying drawings, in which:

FIG. 1 represents, partly in elevation and partly in longitudinal vertical section, a self-loading semi-automatic pistol provided with a breech slide which holds a breech block insert, the pistol incorporating a cartridge extractor, firing pin and related springs, and a floating rib at the base of the insert secured by pins to the insert, the whole secured in the breech slide by a rear sight unit; this view shows the slide in forward battery position, barrel chamber loaded with a cartridge, and the floating rib in the rear position;

FIG. 2 is a partial view of the pistol, partly in elevation and partly in longitudinal vertical section, showing the pistol during the firing cycle with the slide recoiling to the rear, the fired cartridge case being extracted, the case rim being supported by the projecting nose of the floating rib, the floating rib being forced forward by the action of cocking the hammer, friction of the upper cartridge in the magazine and inertia tending to keep the rib forward also.

Figure 5:
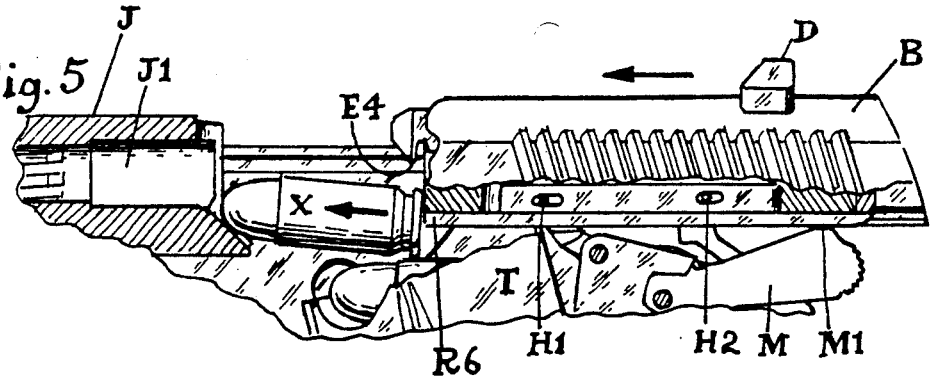
Figure 6:
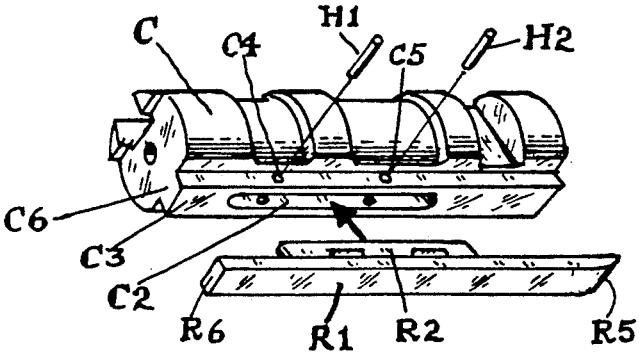
Figure 7:
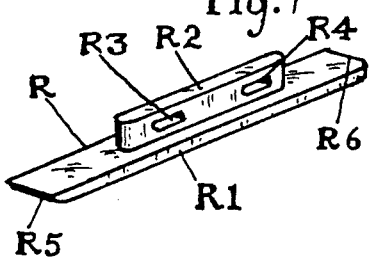

FIG. 5 is a partial view of the pistol, partly in elevation, partly in longitudinal vertical section, showing the slide returning to battery position under recoil spring pressure, the upper cartridge in the magazine being fed into the barrel breech by contact with the slide breech insert breech face, and the sliding rib being forced back by contact with the feeding cartridge base and by friction from the cocked hammer;

FIG. 6 is a perspective view of the slide breech insert as fitted to the previously illustrated pistol, viewed from the lower left front, with a perspective view of the sliding rib from the same viewpoint, in relationship to its fitting in the insert, with the two pins which secure the rib to the insert;

FIG. 7 is a perspective view of the sliding rib, viewed from the upper right side.

Figure 8:
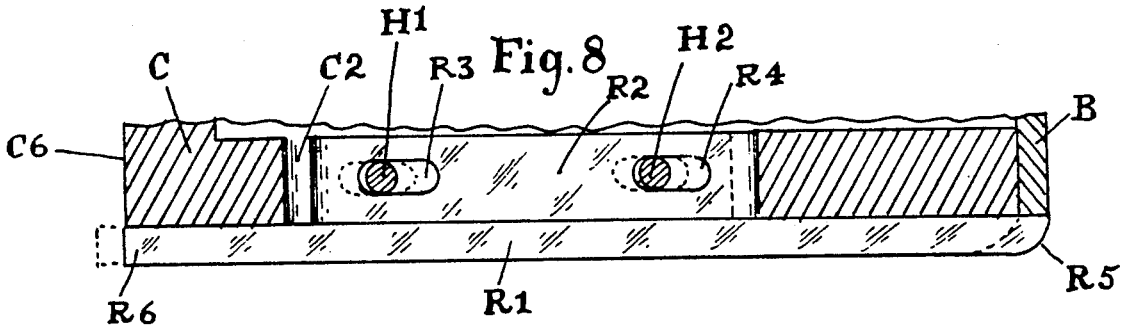
Figure 9:
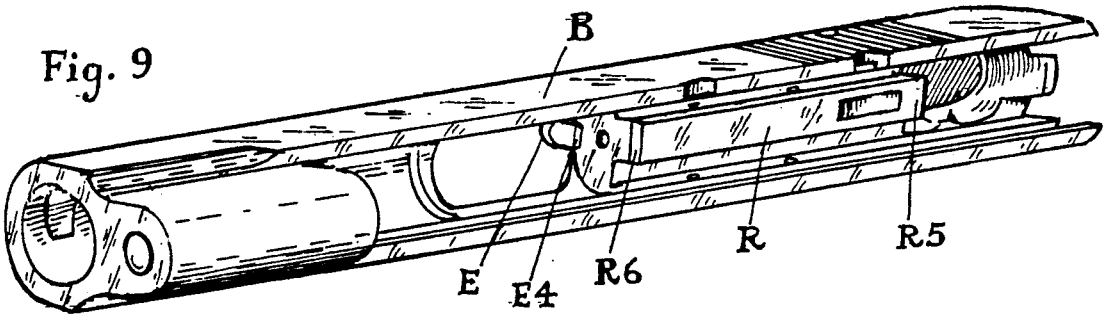
Figure 10:
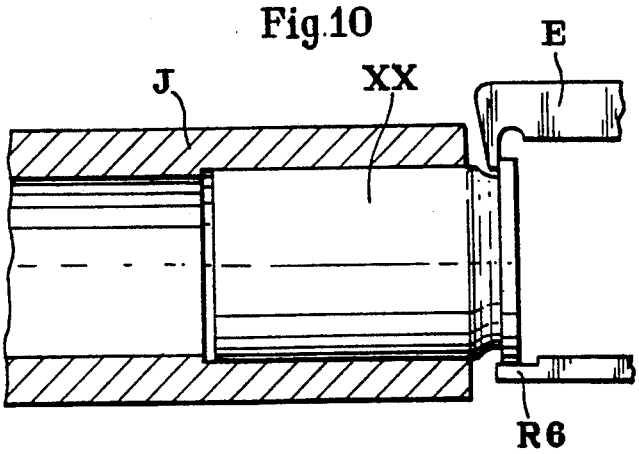

FIG. 8 is a schematic view of the sliding rib held in the slide breech insert by two lateral pins, with the dotted lines showing the limits of movement of the rib;

FIG. 9 is a perspective view of a slide with a solid breech with a sliding rib unit incorporated in the solid breech, this view showing the slide from the front left underneath; and FIG. 10 is a diagrammatic sketch illustrating the position of the extractor immediately after engagement with the cartridge case being extracted.

Figure 1:
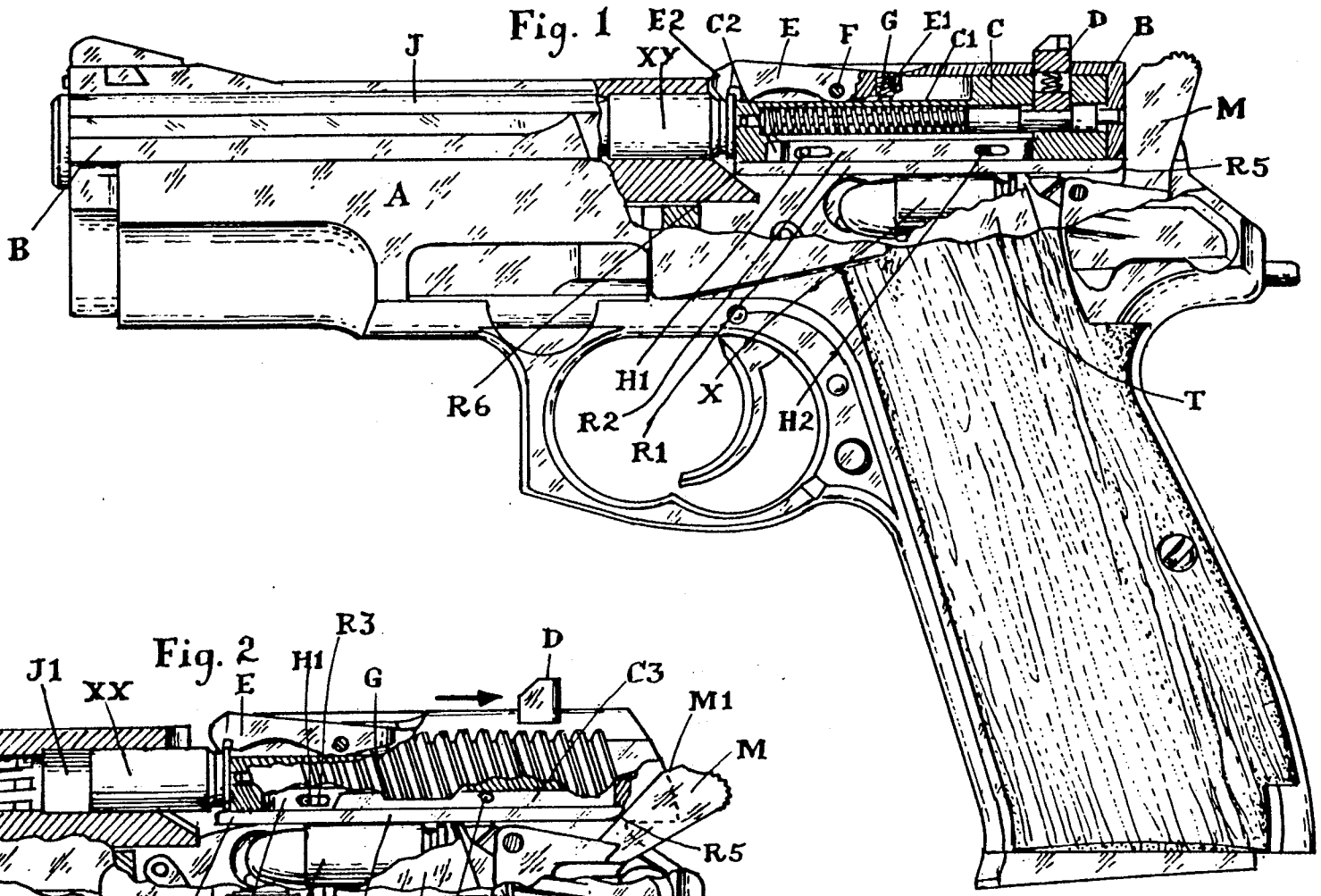
Figure 2:
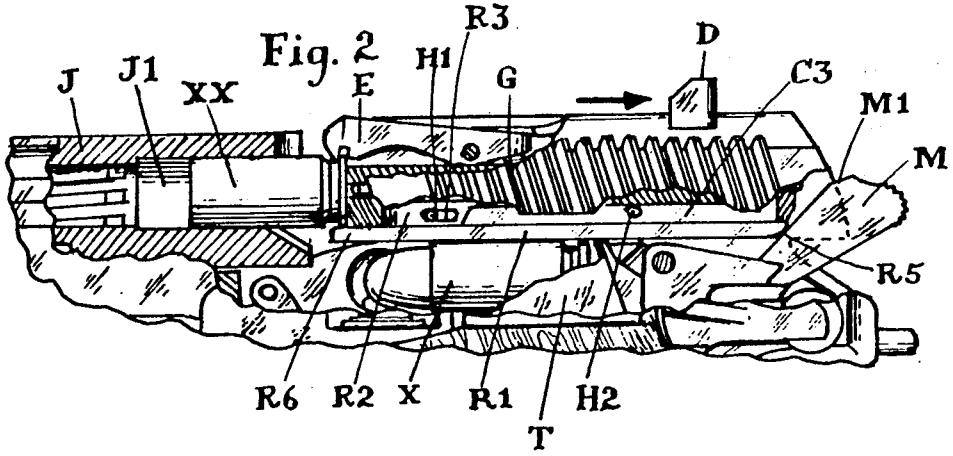

In the self-loading pistol represented in FIG. 1, the slide B is mounted on the frame A by means of rails and grooves and the rear of the slide has a pocket which holds the breech insert C, the insert being retained in position by the rear sight D.

The breech insert has an upper mounted extractor E, held in position by a transverse pin F and sprung loaded by the extractor spring G held in the pocket E1 in the rear of the extractor, the spring G bearing down on the float surface C1 of the breech insert. In the base of the breech insert there is a longitudinal pocket C2 entering vertically through rib C3 and two holes C4 and C5 pass transversely through the rib C3 where the pocket C2 is. A separate unit R has a longitudinal flat plate R1 forming its lower part and a vertically rising, longitudinal rib R2 on its upper surface. The rib R2 has two transverse longitudinal slots R3 and R4 along its length. When the unit R has the rib R2 inserted into the insert pocket C2 the slots R3 and R3 align with the holes C4 and C5 in the insert, allowing pins H1 and H2 to be inserted and thereby hold the rib 6 in insert pocket C2. The slits R3 and R4 allow the unit R longitudinal movement when mated with the breech insert, the degree of movement being restricted by the front and rear extremities of the insert pocket C2. The pins H1 and H2 do not contact either end of the respective slots in rib R2 during forward or rearward movement of unit R, and as the unit R is pressed against the under surface of insert rib C3 by the spring loaded upper cartridge X in the magazine T, and during recoil by the hammer M, the pins are under no load or suffer no impact during the firing of the pistol or cycling of the slide.

Figure 3:
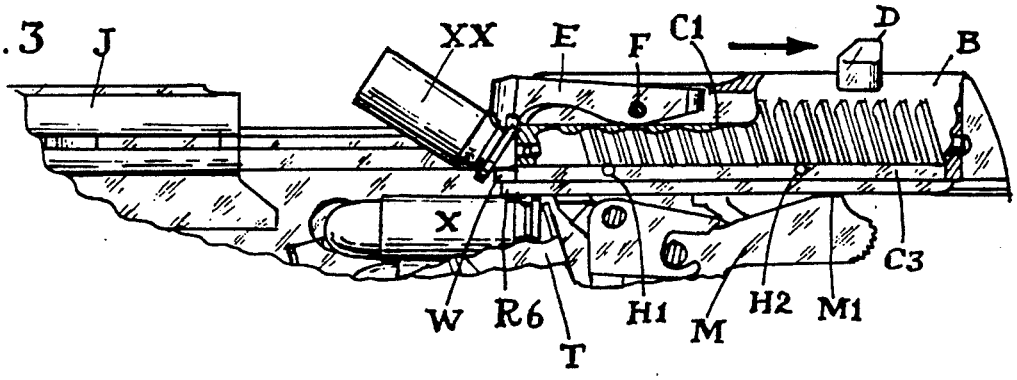
FIG. 3 is a partial view of the pistol, partly in elevation, partly in longitudinal vertical section, showing the slide recoiling, the extracted cartridge case being ejected from the pistol, and the floating rib still overriding the upper cartridge in the magazine, and the cocked hammer bearing against the under surface of the floating rib.

When the slide is in the battery position, or forward, as shown in FIG. 1 and the sliding unit R is in the position as shown in FIG. 8 in solid lines, upon firing the pistol or retracting the slide manually the hammer front face M1 will bear upon the rear end R5 of the slide unit R and tend to force it forward, thereby forcing the nose R6 to protrude forward of the face C6 of the breech insert, or breech face of the solid breech slide as in FIG. 9. The chamber J1 of the barrel J is so machined as to place the rib of the chosen caliber cartridge slightly above the upper surface of the nose R6 of the sliding unit R when the nose is protruding during retraction of the slide, and the spring loaded nose E2 of the extractor will tend to force the rear XX1 of the cartridge XX being extracted down upon the upper surface of the sliding unit nose R6, and thereby hold it firmly aligned with the barrel chamber during extraction. When the slide has travelled to the rear through a distance that does not allow the front face of the breech insert or solid breech to clear to the rear of the upper cartridge in the magazine as in FIG. 3, the nose of the ejector W impacts the base of the extracted cartridge and will tend to eject the cartridge case from the pistol.

Figure 4:
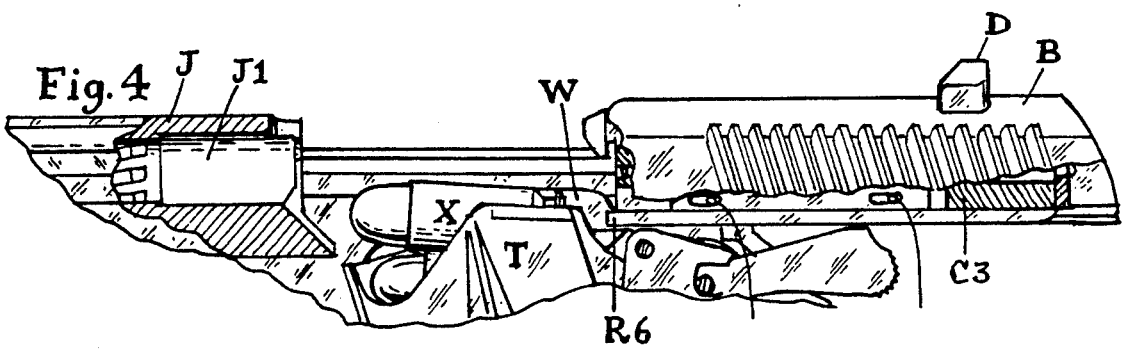
FIG. 4 is a partial view of the pistol, partly in elevation, partly in longitudinal vertical section, showing the slide in full recoil, the upper cartridge in the magazine raised under spring pressure ready to be fed into the barrel breech by the reciprocating slide, and the sliding rib still in the forward position.

When the slide attains the full recoiled position as shown in FIG. 4, the upper cartridge X in the magazine will be clear to rise up to the magazine lips ready to be fed into the barrel breech chamber.

As the slide is impelled forward by spring pressure from the recoil spring the breech face of the breech insert or slide solid breech will impact the base of cartridge X and the sliding rib unit R will be pushed rearwards to be flush with insert face C6. The friction of hammer nose will also tend to move the sliding rib unit rearwards as the slide moves forward. As will be seen from FIG. 5, the sliding rib unit being held to the rear as the slide feeds the cartridge into the barrel chamber will create a flush breech face and enable the feeding cartridge's rim to slide directly under the nose hook E4 of the extractor, creating minimum resistance to the chamber of the cartridge.

Since the sliding rib unit herein described acts as the impact point on chambering a cartridge, and the bearing surface for the upper cartridge in the magazine, plus the surface the cocked hammer rides on during retraction of the slide, and the sliding rib unit can be made of a different material from the breech insert, it is possible for the same insert, or the interior of a solid breech slide, to be made of a lighter or less wear and strength material than the sliding rib unit. Therefore, while the sliding rib unit should be of a high grade steel, the breech insert or interior of the solid breech slide could be made from a light alloy, plastics or other material in order to have means of regulating the weight and inertia of the slide and as a means of economy of construction.

FIG. 10 shows the position of a cartridge XX just as it has started its ejection movement from the chamber in the barrel J by the action of the ejector E. The ejector E is sprung loaded downwardly and thus urges the rim of the cartridge against the supporting nose R6 of the breech slider unit.

The application of the invention to other small arms differs in no essential respect from its application to pistols of the type hereinbefore described.

The terms "horizontal", "vertical", "front", "rear", "right" and "left" as used herein refer to the pistol or other firearm when held in the normal firing position.

I claim:

1. A firearm of the self-loading type having a chamber for receipt of a cartridge to be fired and comprising:

(a) a frame (b) a reciprocating breech block slide mounted for reciprocating movement in the frame between a forward battery position and a retracted position, said breech block slide having an undersurface and including means defining longitudinally extending slot, said breech block slide comprising a detachable breech insert in which said slot is provided;

(c) a cartridge extractor and a firing pin carried by the breech block slide;

(d) a floating under rib having a projection received within said slot, the longitudinal extend of said projection being less than the longitudinal extent of said slot whereby said floating rib is longitudinally movable between a forward position and a rearward position relative to the breech block slide, said floating rib having a forward end which in the forward position of the rib projects beyond the undersurface of the breech block slide to underlie the lower edge of the rear of a cartridge in said chamber when said breech block slide is in its forward battery position, said floating rib forward end cooperating with said lower edge of the rear of the cartridge during initial retraction of the breech block to support the cartridge in order that the cartridge may properly be engaged by the extractor during extraction thereof; and (e) a cockable hammer, means being provided for forcing the floating rib forwardly in said slot by the action of cocking the hammer.

2. A firearm according to claim 1, wherein the floating rib projection has a plurality of longitudinally extending slits therein and wherein a plurality of retaining pins are carried by the breech block slide and are received within said slits to retain the projection in the slot.

3. A firearm according to claim 1, in which the cartridge extractor and firing pin are also carried by the detachable breech insert.

4. A firearm according to claim 1, in which the pistol includes a rear sight carried by the breech block slide, said sight securing the breech insert to the remainder of the breech block slide.

5. A firearm according to claim 1, wherein the pistol includes means for receiving a magazine containing a plurality of cartridges, said floating rib overlying the uppermost cartridge in the magazine when in its forward position in said slot to delay movement of the cartridge from the magazine during use of the firearm until such time as a fired cartridge has been extracted from the chamber.

6. A firearm according to claim 1, comprising a plurality of exchangeable detachable barrels, each barrel being chambered for a different size cartridge ammunition.

* * * * *